US005085031A

United States Patent [19]

McDonald

[11] Patent Number: 5,085,031

[45] Date of Patent: Feb. 4, 1992

[54] TRANSVERSE ZIPPER APPLICATION FOR HORIZONTAL FORM, FILL AND SEAL MACHINE

[75] Inventor: Daniel P. McDonald, Arlington Heights, Ill.

[73] Assignee: Zip-Pak Incorporated, Northbrook, Ill.

[21] Appl. No.: 480,235

[22] Filed: Feb. 15, 1990

[51] Int. Cl.[5] ..... B65B 47/00; B65B 61/18

[52] U.S. Cl. ..... 53/412; 53/410; 53/139.2; 53/133.8; 53/453; 53/559

[58] Field of Search ..... 53/410, 412, 133, 128, 53/453, 559, 133.4, 133.8, 139.2; 206/557; 220/258, 359, 257; 383/63, 64, 65

[56] References Cited

U.S. PATENT DOCUMENTS

| | | | |
|---|---|---|---|
| 3,226,787 | 1/1966 | Ausnit | 383/65 X |
| 3,679,511 | 7/1972 | Ausnit | 383/63 X |
| 3,986,914 | 10/1976 | Howard | 383/63 X |
| 4,240,241 | 12/1980 | Sanborn, Jr. | 53/412 |
| 4,437,293 | 3/1984 | Sanborn, Jr. | 53/133 X |
| 4,782,951 | 11/1988 | Griesbach et al. | 383/63 X |
| 4,817,188 | 3/1989 | Van Erden | 383/63 |
| 4,844,759 | 7/1989 | Boeckmann | 383/63 X |
| 4,846,585 | 7/1989 | Boeckmann et al. | 383/65 X |
| 4,894,975 | 1/1990 | Ausnit | 53/451 |
| 4,896,775 | 1/1990 | Boeckmann et al. | 383/64 X |
| 4,901,505 | 2/1990 | Williams, Jr. | 53/412 |

*Primary Examiner*—John Sipos

*Attorney, Agent, or Firm*—Hill, Van Santen, Steadman & Simpson

[57] ABSTRACT

A method of forming a series of tray containers from plastic sheet film including intermittently continuously advancing a sheet of film, forming pockets in the film by heating and pressure differential across the film, laterally delivering closure strips between the pockets with the closure strips doubled, and having upper and lower layers with rib and groove fastener profiles therebetween, attaching the lower layer of the fastener to the web at the upper and lower edges of the fastener, laying an upper layer of film over the lower layer and attaching it to the lower layer around the edges of the pockets and attaching the upper layer of film to the top edge of the doubled fastener strip with the upper layer of the fastener strip having a tear perforation sealed by a sealing strip below the rib and groove elements.

13 Claims, 2 Drawing Sheets

TRANSVERSE ZIPPER APPLICATION FOR HORIZONTAL FORM, FILL AND SEAL MACHINE

BACKGROUND OF THE INVENTION

The present invention relates to improvements in methods of making plastic bags or pouches from film, and more particularly to making shaped pouches with reclosable fastener strips along the top.

In the manufacture of bags and pouches, particularly those suited for the holding of foodstuffs, it is desirable to provide a pouch which has a sealed top to avoid contamination of the food product therein and to avoid escape of liquids or oils contained in the food product. A further desirable feature of the bag is to provide for greater usability in making the bag so that it can be opened and resealed. An optimum form of closure to satisfy these desirable objectives is to provide a rib and groove interlocking closure across the top of the finished pouch. The interlocking closure is such that it is initially backed up by a tamper-evident seal which generally constitutes a web extending between the sides of the interlocking rib and groove closure but which is frangible so as to be able to be broken when the bag is first used. To provide such a structure, establishes problems in manufacture.

The manufacture of reclosable bags should be conducted at a commercial pace or speed. The manufacturing operation must manufacture the bag, attach the closure and include the product within the bag in a single relatively high speed operation.

FEATURES OF THE INVENTION

It is an object of the present invention to provide an improved method of making a bag of plastic film with a reclosable zipper along the top joined by a temporary sealed perforated web which provides a tamper-evident feature and which protects the profiled fastener from foodstuffs within the bag and which also provides a tamper-evident bag to let the first user know whether access to the bag has been previously had.

A further object of the invention is to provide an improved method of continuously making bags with reclosable fasteners wherein the product is placed in the bag in the manufacturing operation.

A still further object of the invention is to provide an improved way of making bags with product containing pockets therein wherein a plurality of bags can be made in a single step where a fastener for all of the bags is attached in the same operation.

A further object of the invention is to provide a method where pouch-type reclosable bags can be manufactured with a saving of the zipper material that is required.

In the process of manufacture in accordance with the invention, a first sheet of web is laid down and pockets are formed therein. Doubled fastener strips are laid laterally across the webs between the pockets and attached to the first web at the upper and lower edge of the doubled strip. The product is then placed in the pocket and the upper web is laid over the lower and sealed around its edge and sealed at the outer edge to the fastener strip. The doubled fastener strip has a perforation extending thereacross so that it can be broken with the perforation located below the interlocked rib and groove of the fastener strip. A sealing strip is placed over the perforations.

Other objects, advantages and features will become more apparent with the teaching of the principles of the invention in connection with the disclosure of the preferred embodiment in the specification, claims and drawings, in which:

DESCRIPTION OF THE PREFERRED EMBODIMENT

Figure 1:
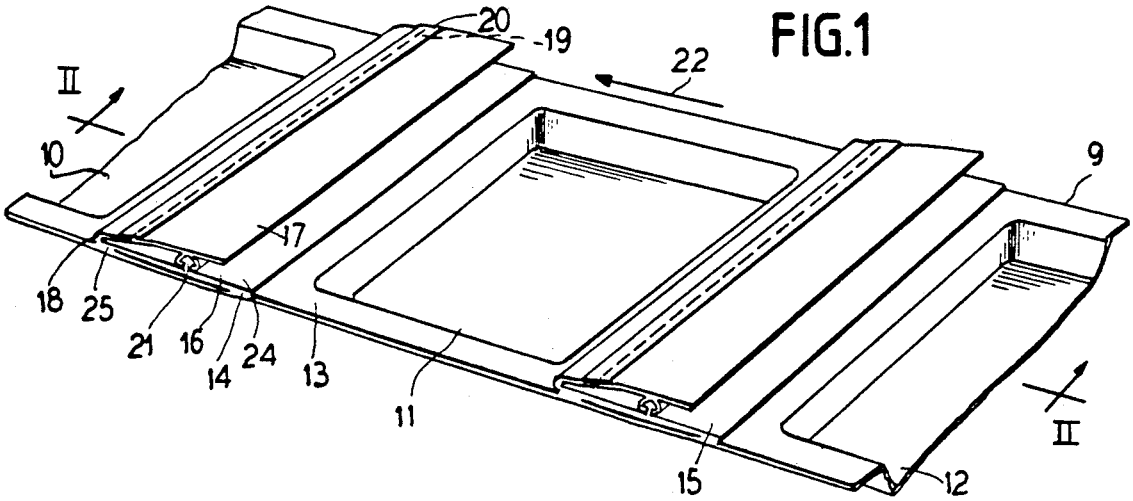
FIG. 1 is a fragmentary perspective view illustrating the method of making pouches wherein a lower sheet has pockets formed therein and fastener strips are located between the pockets.
Figure 2:
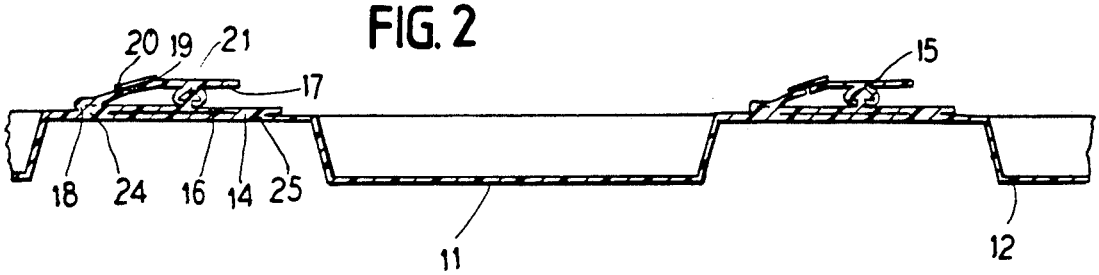
FIG. 2 is a vertical sectional view taken substantially along line II—II of FIG. 1.

FIG. 1 shows a lower sheet of film 9 fed forwardly in the direction of the arrowed line 22. At a spaced intervals, the sheet is stopped and pockets 10, 11 and 12 are formed therein. One manner in which these pockets are formed is by the application of heat to the film and applying a pressure differential to force the film into shaped molds. The pressure differential may be generated by suction beneath the film with the film being softened solely in the area opposite the mold. Supports may be arranged around the edge of the mold so that the sheet takes the shape illustrated in FIG. 1 with the supported edge of the pouch 11 shown at 13.

Doubled fastener strips 14 and 15 are laid across the first sheet at spaced intervals. The doubled fastener strips are located between the individual pockets.

Figure 6:
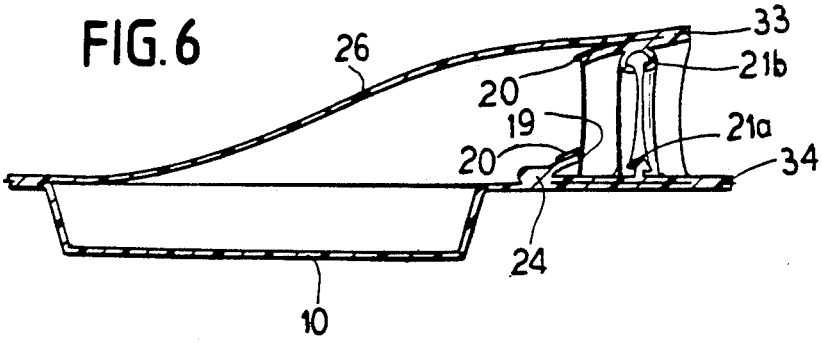
FIG. 6 is a vertical sectional view indicating the manner in which the bag is first opened.

The strips are doubled so that they have a lower layer 16 and an upper layer 17. The layers are doubled at their lower edge 18. Interlocked rib and groove elements 21 are located between the layers of the fastener strip 14 with the interlocked closure elements including a rib element 21*a*, FIG. 6, and a complementary shaped groove element 21*b*.

As illustrated in FIG. 1, the doubled fastener strip 14 also has tear perforations 19 extending therealong at a location beneath the rib and groove elements 21. The perforations are sealed by a sealing strip 20 laid over the perforate opening. With the doubled fastener strip, even if the rib and groove elements 21 are separated, the doubled edge 18 of the fastener strip still provides a positive closure for the contents of the bag. For the first user to obtain access to the bag, he must tear the strip at the perforations 19. This, of course, provides a tamper-evident closure which completely seals the contents and yet can be torn so that in continued use, the rib and groove elements 21 may be separated and reclosed. This is particularly advantageous for a container having foodstuffs therein.

The lower layer 16 of the fastener strip is attached to the first sheet 9 only along a narrow area 24 at the top edge of the layer and along a narrow line 25 at the bottom doubled edge 18 of the closure strip layer. This leaves an unattached area between the sealed lines 24 and 25.

The other closure strip 15 is similarly constructed and similarly attached and the strip 14 will provide the top closure for the bag 10 with the strip 15 forming the top closure for the bag 11.

Figure 5:
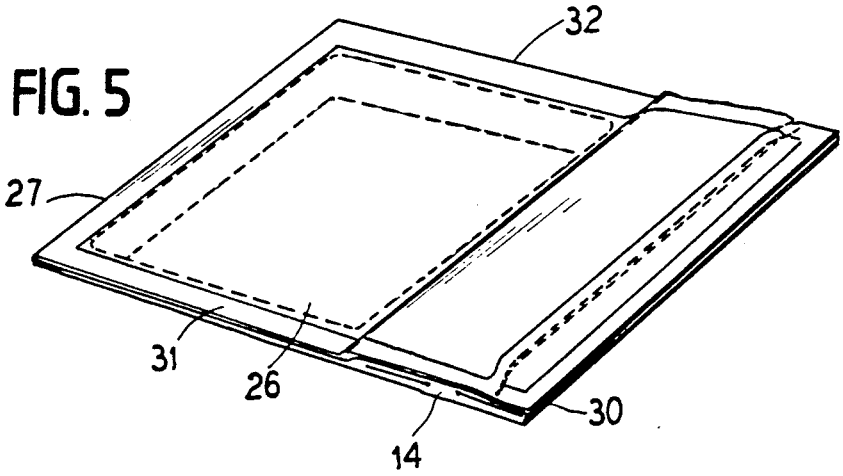
FIG. 5 is a perspective view of a completed single pouch.

The next step in the practice of the method is to place the contents within the interior of the recessed part of the pouch. Then a top sheet 26 is laid over the lower pouch. The top sheet 26 is sealed to the lower sheet along its edge, and as illustrated in FIG. 5, a cross-seam 27 forms the bottom of the completed bag and side seams 31 and 32 form the sides of the bag.

The top sheet is sealed to the top layer of the fastener strip along its top edge at 28. This sealing may be accomplished by the application of heat. To avoid inadvertent joining of the plastic layers, a heat transmission preventing member may be inserted between the layers of the fastener strip. For example, a Teflon member may be inserted. Also, the plastic used for the fastener strip may be of a nature so that the heat required to join the sheet 26 to the strip is less than that which would join the edges of the fastener strip.

The upper sheet will be fed from a supply 24 passed over a roll 25 and the seams formed by the application of heat.

The top layer then may be cut at 31, which cut extends also through the bottom layer so that the pouch will be severed from the supply.

Figure 4:
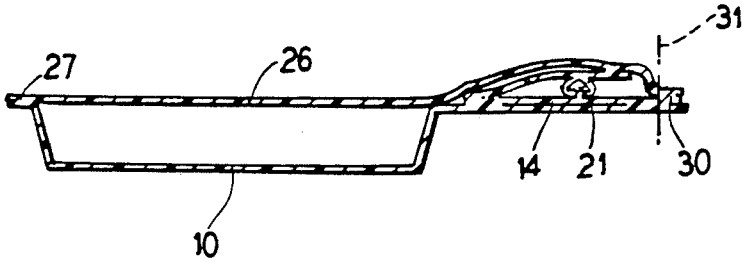
FIG. 4 is a vertical sectional view similar to FIGS. 2 and 3 and indicating the completion of the bag.

As an option that is available, as shown in FIG. 4, the top edges of the layers of the fastener strip may be seamed to each other at 30. This provides another seal for the outer top edge of the bag. When the bag is to be used, the top edge is cut off along a line 31 thus leaving pull flanges for separating the rib and groove elements 21.

FIG. 5 illustrates the completed pouch after it is separated from the supply and as it appears for storage ready for first use.

When the pouch is to be used, pull flanges 33 and 34 are pulled apart to separate the rib 21*a* from the groove 21*b*. Continued pull on the flanges 33 and 34 tears the perforations 19 and tears the sealing strip 20 so that access to the bag is afforded. Thereafter, the contents can be partially removed and the rib and groove are rejoined to seal the bag.

Figure 3:
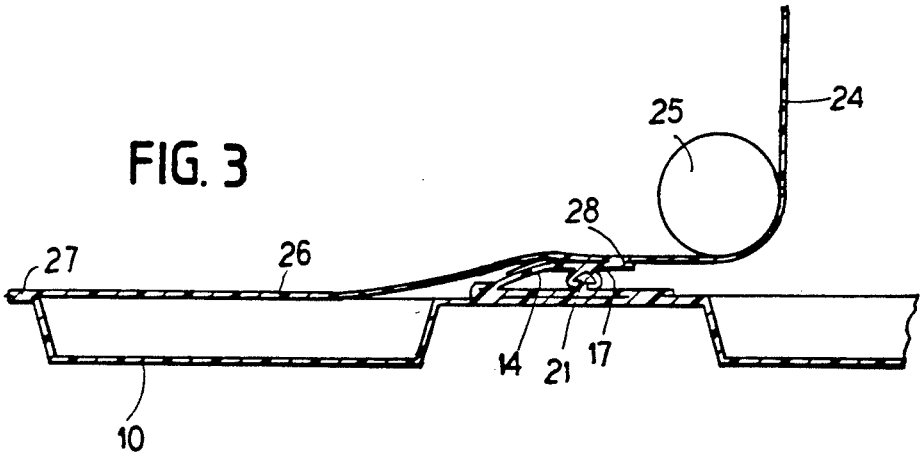
FIG. 3 is a view similar to FIG. 2 illustrating the upper sheet being placed on the pouch.
Figure 7:
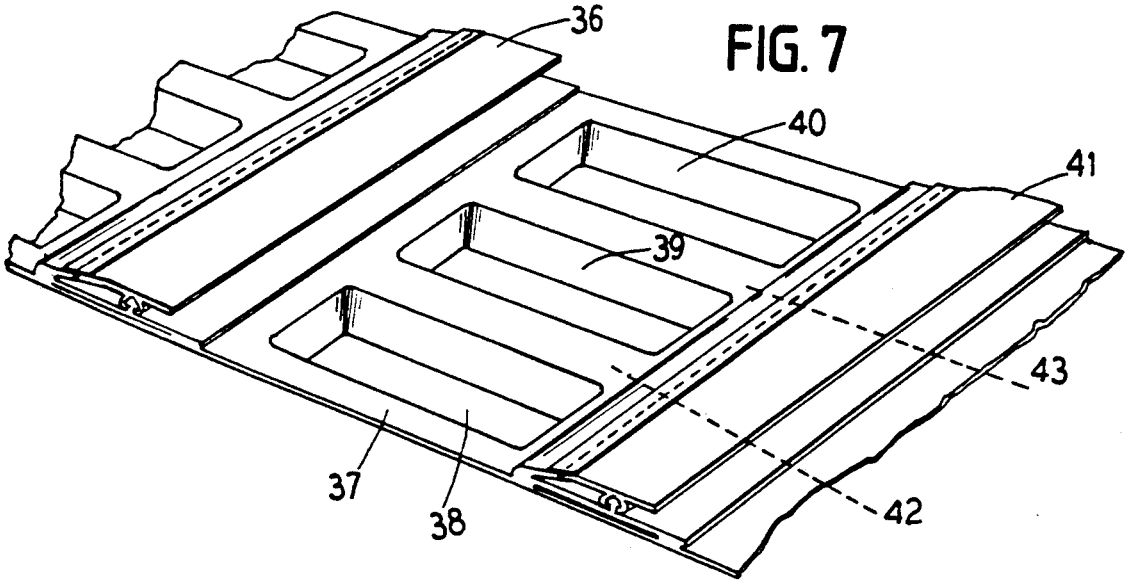
FIG. 7 is a perspective view illustrating the manner in which multiple bags are made in a single operation.

As illustrated in FIG. 7, a plurality of pouches may be simultaneously manufactured with similar pockets 38, 39 and 40 spaced laterally across the web 37. Fastener strips such as 36 and 41 are attached across the web. The pouches then can be completed following the same process as described in connection with FIGS. 3 and 4. The different pouches then can be separated by cutting between them longitudinally along lines 42 and 43.

As will be observed, a saving in the length of the fastener strip required is affected since every bit of the fastener strips is utilized in the resultant bag.

If a bag were made wherein the strip had to be fed longitudinally parallel to the sheet feed, the same dexterity in design and saving in material would not be afforded.

Thus, it will be seen that I have provided an improved method of the formation of bags which are particularly suited for foodstuffs and which method achieves the objectives and advantages above set forth. The method adapts itself well to manufacturing procedures and to relatively high speed production. The process lends itself extremely well to variations in bag making and bag shapes. One advantage is that normally the manufacturer will include printing on the top surface of the upper sheet of film. The zipper is always on the same side relative to the printing. The zipper also can be located always on the short side of the bag so that less zipper is needed. The zipper can always be at the bag opening, and it is not necessary to go to sealed areas for opening.

The method accommodates itself well to different shapes of bags and the zipper can always be critically located. When the process of having the zipper run longitudinally with the material is used as heretofore was necessary, this dexterity was not possible. For example, it is possible to make triangular bags with a full zipper in accordance with the present method.

I claim:

1. A method of forming a series of tray containers from plastic sheet film comprising the steps of:

advancing a first continuous web of plastic film in a longitudinal direction of sheet feed; shaping the web to form a product containing pocket therein including outer peripheral flange areas;

laying, across the web, a doubled fastener strip to extend laterally across the web on a flange area with the strip having upper and lower layers and being folded transversely at an inner edge relative said pockets and including interlocking rib and groove fasteners extending therealong between the layer, and forming in the upper layer of said strip a frangible tear line inwardly of the rib and groove fasteners and outwardly of the folded edge of the strip whereby a tamper-evident closure is provided;

attaching the doubled strip to the first web;

laying a second web over the first web; and attaching the second web to the upper layer of the strip only outwardly of and spaced from the tear line whereby an outer portion of the upper layer of the strip will remain with the second web when the tear line is separated and the fasteners are separated.

2. The method of forming a series of tray containers from plastic sheet film in accordance with claim 1, and further defined as:

shaping the product container in the first web by heating the first web.

3. The method of forming a series of tray containers from plastic sheet film in accordance with claim 1, and further defined as:

applying a pressure differential across the web to form a product pocket.

4. The method of forming a series of tray containers from plastic sheet film in accordance with claim 3, and further defined as:

attaining the pressure differential by application of a suction to the outer surface of the web.

5. The method of forming a series of tray containers from plastic sheet film in accordance with claim 1, and further defined as:

attaching the lower part of the fastener to the first web and the upper part of the fastener to the second web.

6. The method of forming a series of tray containers from plastic sheet film in accordance with claim 1, and further defined as:

attaching the lower layer of the fastener to the first web at upper and lower edges thereof with an area intermediate the edges free of attachment.

7. The method of forming a series of tray containers from plastic sheet film in accordance with claim 1, and further defined as:

forming the tear line as perforations in the upper layer and covering the perforations with a sealing strip.

8. The method of forming a series of tray containers from plastic sheet film in accordance with claim 1, and further defined as:

attaching the upper layer of the fastener strip only at an outer edge thereof outwardly of said pocket to the second web.

9. The method of forming a series of tray containers from plastic sheet film in accordance with claim 1, and further defined as:

forming a plurality of product pockets in the first web separated laterally across the first web.

10. The method of forming a series of tray containers from plastic sheet film in accordance with claim 9, and further defined as:

cutting the webs and the fastener strip between each of the pockets to form a plurality of individual containers.

11. The method of forming a series of tray containers from plastic sheet film in accordance with claim 1, and further defined as:

delivering the doubled fastener strip onto the first web moving laterally of the web direction of sheet feed.

12. A method of forming a series of tray containers from plastic sheet film, comprising the steps of:

advancing a first continuous web of plastic film in a longitudinal direction of sheet feed with said web having a series of spaced pockets therein with peripheral flange areas surrounding the pockets;

laying a doubled fastener strip across and extending laterally across the web on a flange area with the strip having upper and lower layers joined along a transverse inner edge relative said pockets with interlocking rib and groove fasteners extending therealong between the layers, and forming a frangible tear line inwardly of the rib and groove fasteners and outwardly of said joined edge of the strip to provide a tamper-evident closure;

attaching the doubled strip to the first web; and laying a second web over the first web to provide a cover over the pockets and the flange areas and attaching the second web to the upper layer of the strip only outwardly of the tear line whereby an outer portion of the upper layer of the strip will remain with the second web when the tear line is separated and the fasteners are separated.

13. The method of claim 12, and further defined as:

attaching the second web to the first web outwardly of the fasteners.

* * * * *